US008175796B1

(12) United States Patent
Blackburn et al.

(10) Patent No.: US 8,175,796 B1
(45) Date of Patent: May 8, 2012

(54) METHOD FOR VEHICLE COLLISION AVOIDANCE

(75) Inventors: Michael R. Blackburn, San Diego, CA (US); Nghia Tran, San Diego, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 723 days.

(21) Appl. No.: 12/237,460

(22) Filed: Sep. 25, 2008

(51) Int. Cl.
*G08G 1/16* (2006.01)

(52) U.S. Cl. ..... 701/301; 701/300; 340/902

(58) Field of Classification Search ..... 701/300, 701/301, 302, 303; 340/900, 901, 902, 903, 340/904, 905
See application file for complete search history.

(56) References Cited

U.S. PATENT DOCUMENTS

| | | | | |
|---|---|---|---|---|
| 6,405,132 | B1 * | 6/2002 | Breed et al. | 701/301 |
| 7,286,040 | B2 * | 10/2007 | Karabinis | 340/10.1 |
| 7,482,916 | B2 * | 1/2009 | Au et al. | 340/475 |
| 2002/0190856 | A1 * | 12/2002 | Howard | 340/531 |
| 2006/0116821 | A1 | 6/2006 | Kim et al. | |
| 2008/0040029 | A1 | 2/2008 | Breed | |
| 2008/0119966 | A1 * | 5/2008 | Breed et al. | 701/2 |

OTHER PUBLICATIONS

Sensing of Passing Vehicles Using a Lane Marker on a Road With Built-In Thin-Film MI Sensor and Power Source, IEEE Transactions on Vehicular Technology, vol. 53, No. 6, Nov. 2004.*

* cited by examiner

*Primary Examiner* — Mary Cheung
*Assistant Examiner* — Truc M Do
(74) *Attorney, Agent, or Firm* — Ryan J. Friedl; Kyle Eppele

(57) ABSTRACT

A method involves transmitting a first signal to a device, the first signal comprising vehicle identification data and vehicle operational data, receiving a second signal from the device, the second signal comprising road and lane information and vehicle information vectors of other vehicles transiting the road in range of the device, and determining a collision risk based upon the received second signal. The method involves the range-limited communication of vehicle information vectors among a network of devices. The method may include transmitting an operational signal to a vehicle controller, wherein the operation of a vehicle, such as speed, braking, and steering, is altered by the vehicle controller based upon the received operational signal. The method may involve, if the determined collision risk exceeds a predetermined threshold, the transmission of a warning signal by a vehicle computer to a vehicle operator via a warning device controlled by a vehicle controller.

5 Claims, 14 Drawing Sheets

METHOD FOR VEHICLE COLLISION AVOIDANCE

FEDERALLY SPONSORED RESEARCH AND DEVELOPMENT

The Method for Vehicle Collision Avoidance is assigned to the United States Government and is available for licensing for commercial purposes. Licensing and technical inquiries may be directed to the Office of Research and Technical Applications, Space and Naval Warfare Systems Center, San Diego, Code 2112, San Diego, Calif., 92152; voice (619) 553-2778; email T2@spawar.navy.mil. Reference Navy Case No. 99168.

BACKGROUND

As the number of vehicles on the road increases, so does the probability of collisions between vehicles. While some collisions are unavoidable, other collisions may be prevented if adequate warning of the potential collision is provided to a vehicle controller or a vehicle operator. Systems have been developed to provide such warnings. Active cruise control (ACC) is an example of such a system. However, as ACC is limited to the detection range of the vehicle's sensors, ACC will fail to respond to potential collision events outside of the vehicle's sensor field. Other systems attempt to solve the problem of assessing collision risk by the use of high resolution RADAR, LIDAR, and stereo vision. While useful, such systems suffer from deficiencies such as an inability to see around the corners of buildings and other structures that interfere with photon line of sight, high per vehicle cost, and, in the case of RADAR and LIDAR, from the competitive emission of electromagnetic energy into the environment.

There exists a current need for an accurate and reliable method for collision avoidance that is not constrained by a vehicle's sensors and that does not rely on line-of-sight detection.

DETAILED DESCRIPTION OF SOME EMBODIMENTS

Figure 1:
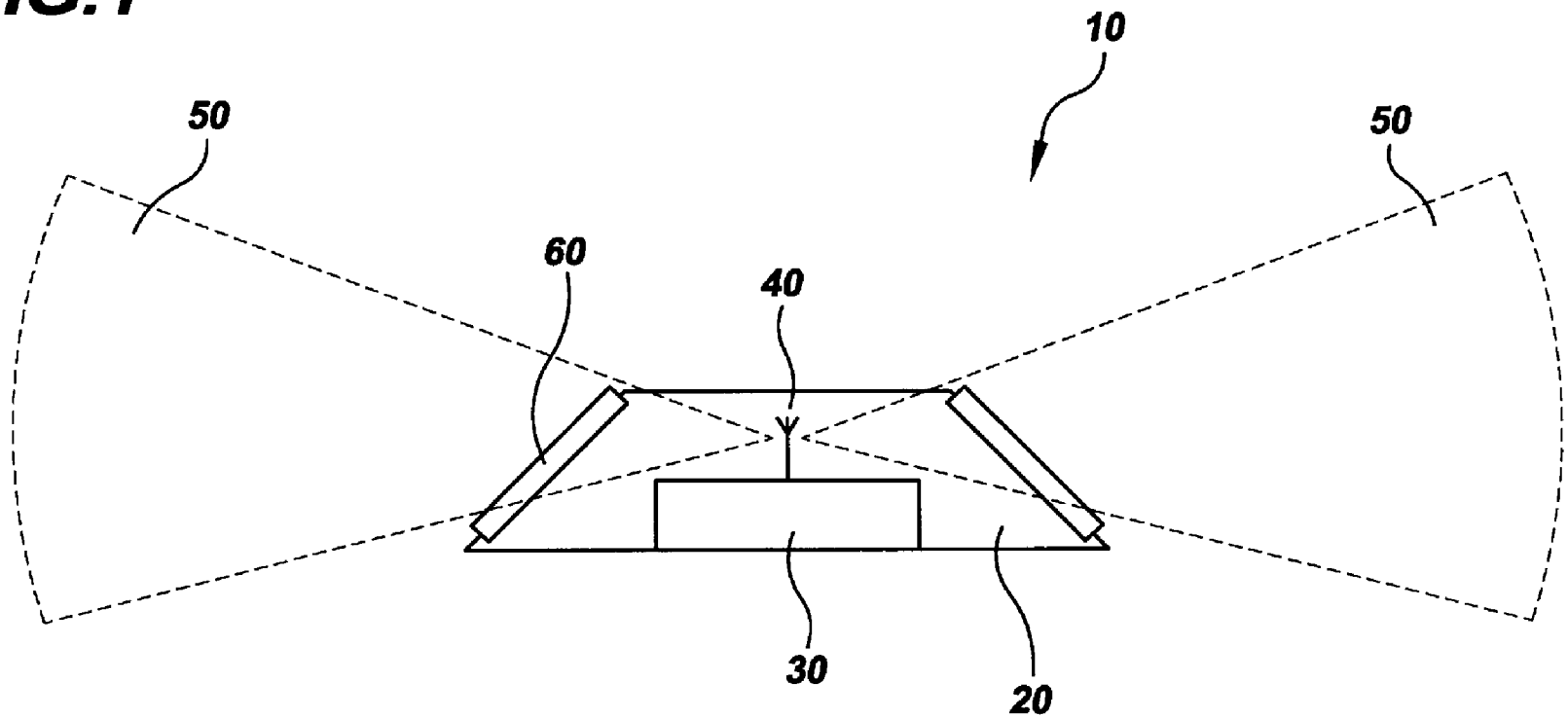
FIG. 1 shows a diagram of an embodiment of a radio frequency identification (RFID) component incorporated into a roadway lane marker, forming a reactive lane marker (RLM).

FIG. 1 shows a diagram of an embodiment of a reactive lane marker (RLM) 10 that may be used with the Method for Vehicle Collision Avoidance. RLM 10 includes a base portion 20, a radio frequency identification (RFID) component 30, an antenna 40 configured to radiate a beam 50, and reflectors 60. RFID component 30 may include a transceiver, a processor, and memory. Antenna 40 may be designed for omni-directional high gain operation.

Figure 2:
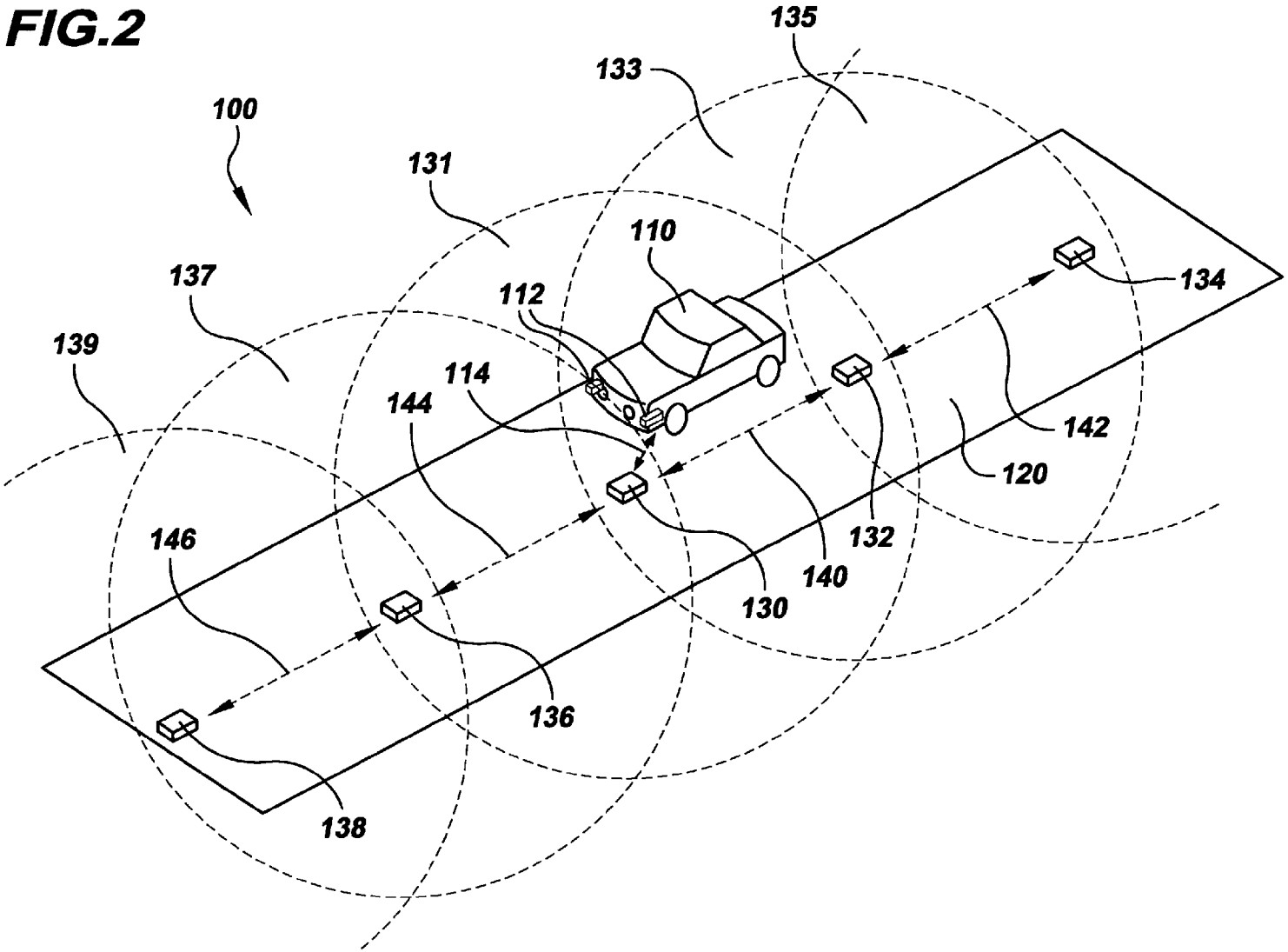
FIG. 2 shows a diagram illustrating an embodiment of a vehicle travelling along a road with multiple RLMs.

FIG. 2 shows a diagram illustrating an embodiment of a vehicle 110 travelling along a road 120 with multiple RLMs. Vehicle 110 includes two RFID transceivers 112 coupled thereto. Transceivers 112 may be located within the cab, trunk, or engine compartment of vehicle 110, or otherwise attached to the exterior of, or contained within, vehicle 110. In some embodiments, vehicle 110 contains two transceivers—one located on each side of vehicle 110 behind the front bumper. Vehicles that approach an RLM communicate with the RLM through a vehicle antenna oriented in the direction of the approach, while the departing vehicle's directionally oriented RFID reader does not communicate with the previously encountered RLM. Transceivers 112 communicate to RLMs 130, 132, 134, and 136 via wireless link 114, which may be an RF link.

As shown, RLMs 130, 132, 134, 136, and 138 are distributed uniformly along road 120. As an example, RLMs may be distributed every ten feet along road 120. In some embodiments, the RLMs may be non-uniformly distributed along road 120. RLMs 130, 132, 134, and 136 may be positioned along the centerline of road 120. In other embodiments, RLMs 130, 132, 134, and 136 may be positioned at the side of, or off of, road 120. RLMs 130, 132, 134, 136, and 138 are connected together to form a network. RLM 130 is connected to RLM 132 via link 140, RLM 132 is connected to RLM 134 via link 142, RLM 130 is connected to RLM 136 via link 144, and RLM 136 is connected to RLM 138 via link 146. In some embodiments, links 140, 142, 144, and 146 may be wireless links, such as RF links. RLM 130 has an RF range 131, RLM 132 has an RF range 133, RLM 134 has an RF range 135, RLM 136 has an RF range 137, and RLM 138 has an RF range 139. As shown, RF ranges 131, 133, 135, 137, and 139 may overlap.

In operation, an RFID transceiver communicates with the nearest in-range RLM as the vehicle progress over the RLM-equipped road. Each RLM communicates with its immediate neighbors through the RF link, such as links 140, 142, 144, and 146, and communicates with each vehicle in RF range area that encounters it. The information communicated by RLMs is used by the vehicle's onboard navigation system (shown in FIGS. 3 and 4), which may be part of an existing GPS navigation computer, for determination of collision risk and a collision avoidance response.

Each RLM that detects a vehicle downloads the vehicle information and propagates that information on the network of RLMs in the roadway according to propagation rules. As an example, all RLMs may propagate information received from other RLMs, in accordance with the following rules:

1. Propagation is initiated only after a RLM encounters a vehicle and data are exchanged between the vehicle and the RLM.
2. Propagation is initiated only one time per encounter.
3. If an RLM receives a broadcast containing a VIN line that it has broadcast in the previous 10 msec, no rebroadcast of that VIN line occurs. This rule prevents oscillations of broadcasts between neighboring RLMs as vehicles encounter RLMs at intervals greater than 45 msec when traveling at speeds less than 150 mph.
4. If an RLM receives any VIN line that it had not previously broadcast in the previous 10 msec, it immediately decrements the hop count of the VIN line and, if the hop count is greater than 0, adds it to its data matrix and rebroadcasts the resulting VIN line.
5. When the hop propagation integer is reduced to 0 for any VIN-line, the associated VIN-line is deleted from the current matrix. Thus, only non-zero data are preserved and propagated.
6. If the RLM is located at a road intersection, it appends to the end of each VIN-line update it receives the current hop count number of that VIN line (which does not decrement with additional hops as does the original hop count number).
7. A vehicle stopped in the roadway may communicate periodically with the most proximate device and modify its hop count based on traffic conditions as uploaded from that device.

The propagation is completed when all RLMs have received the VIN line of the vehicle on that section of the road that most recently encountered a new RLM, and the hop count of that VIN line is greater than zero. RLMs may maintain the data in nonvolatile memory until the data are modified and the hop count number reaches zero, at which point the VIN line is deleted at that location. When the vehicle is moving on the roadway, its RFID reader gets within range of the next RLM and an exchange of information again takes place.

The vehicle remains in range of the next RLM for a period of time that is vehicle speed dependent, but information is exchanged only upon entry into communication range. The new information is propagated as above, but now if no other vehicle parameters have changed such as speed and direction, the subsequent RLMs receive VIN lines identical to those stored in memory except for the hop count which is one higher going in the direction of vehicle travel and one lower going in the opposite direction. The VIN line information stored in each RLM is updated with the new hop count number and any changes in vehicle speed or lane and reader code.

The speed of data propagation through the network of RLMs exceeds the change rate of vehicle specific data as vehicles traverse the roadway encountering sequential RLMs. Update rates to the data matrix contained in the network of RLMs depend upon the processing speed of the RLMs and the communication rate from RLM to RLM, and the rate at which vehicles encounter new RMLs, which is entirely dependent upon vehicle speed and density. For example, the upper limit of data transfer through any node within the network using state-of-the-art RFID technology is approximately 100 bits/msec. Under the conditions of a two-lane boulevard with vehicles traveling at an average speed of 55 mph, each encountering a new RLM every 123 msec, and maintaining a average stand-off distance of 20 feet, the RLM network could be expected to update the information on the 12 vehicles with overlapping VIN ranges that could constitute the local traffic.

Figure 7:
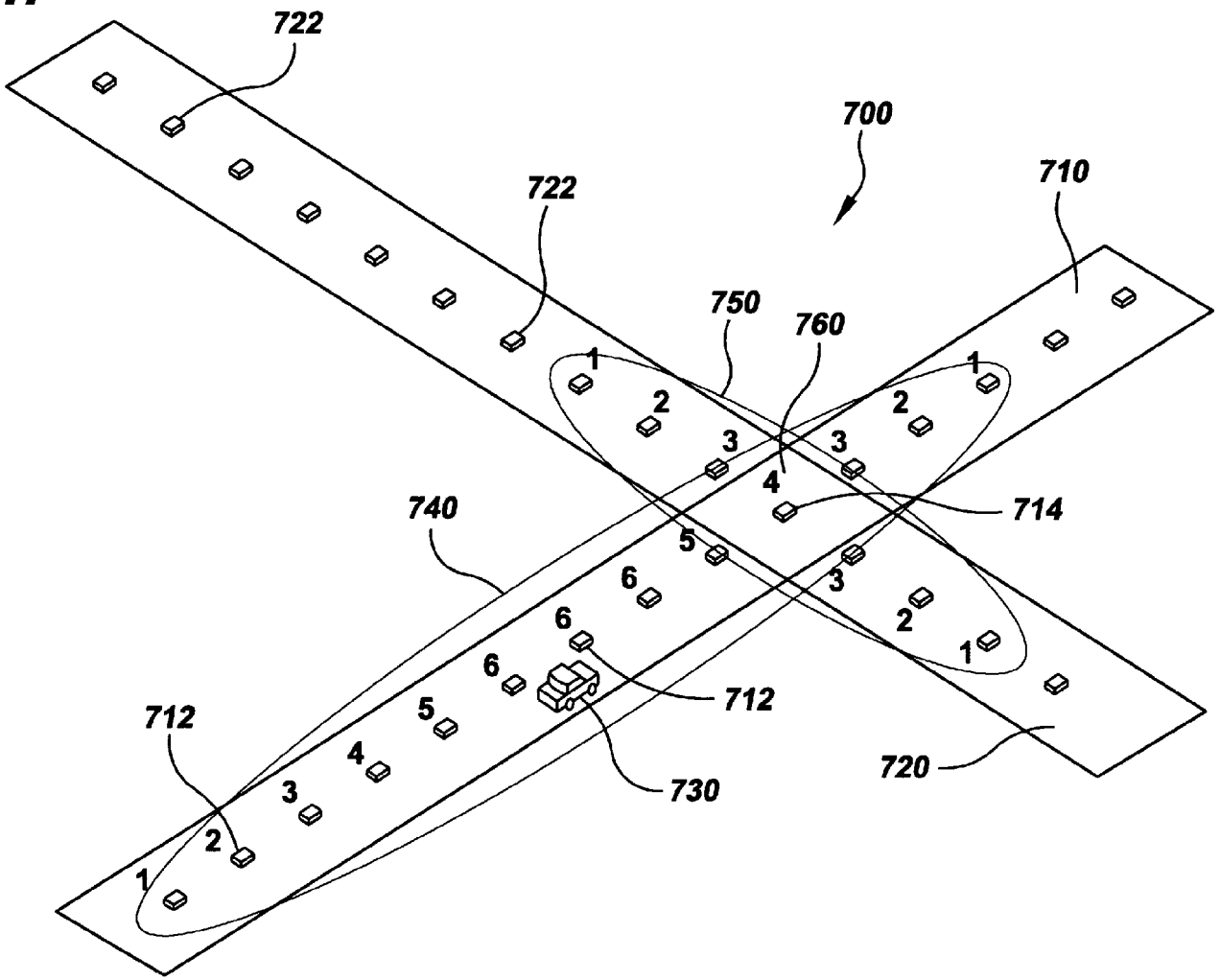
FIG. 7 shows a diagram of the propagation of a vehicle identification range by multiple RLMs near an intersection.
Figure 8:
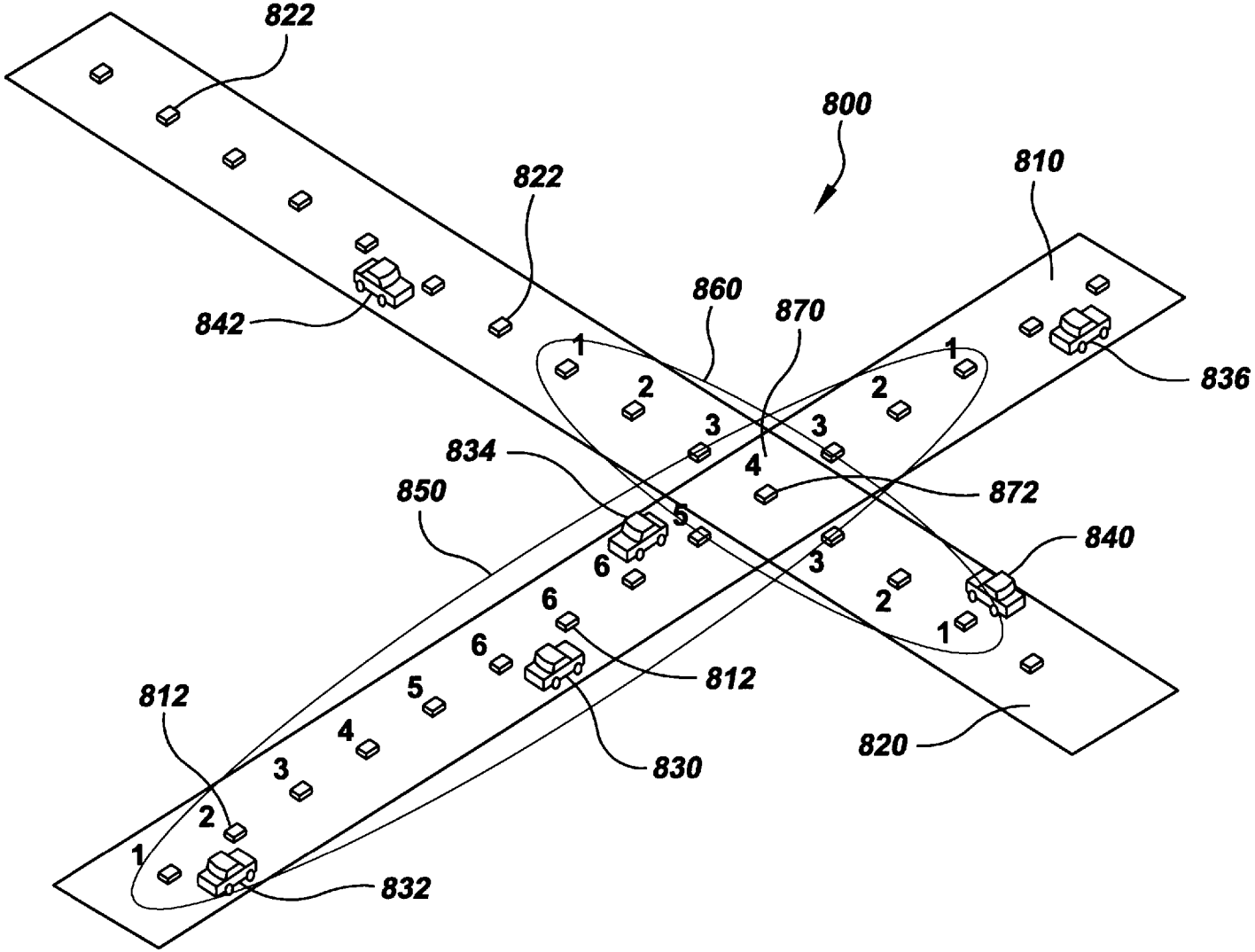
FIG. 8 shows a diagram of multiple vehicles within a vehicle identification range of a particular vehicle approaching an intersection.
Figure 9:
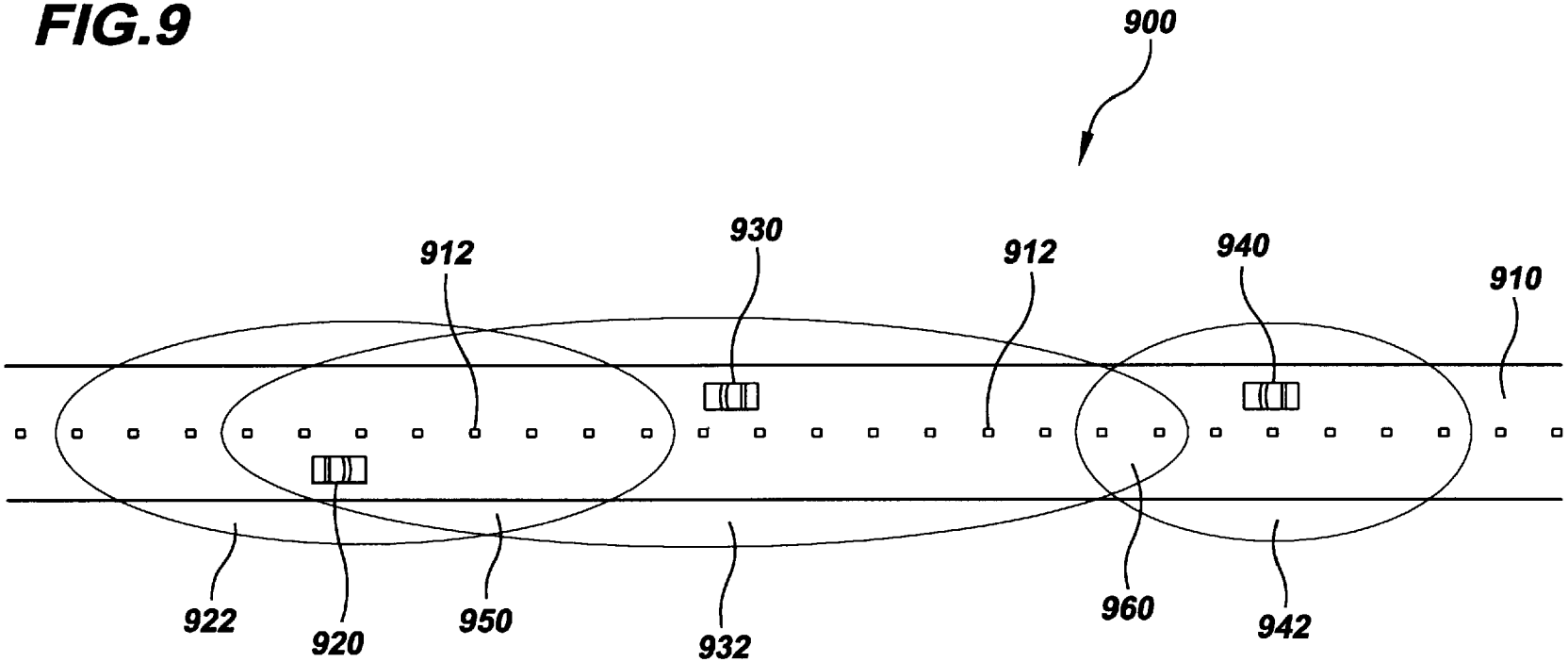
FIG. 9 shows a diagram of the intersection of vehicle identification ranges for multiple vehicles.

The information contained in the RLM network related to any one vehicle is called a VIN range. The size of the VIN range, defined by the number and distribution of RLMs that contain a specific VIN line, is directly related to vehicle speed. Higher vehicle speeds generate larger (longer) ranges in the network. VIN ranges are shown in FIGS. 7, 8, and 9.

Figure 3:
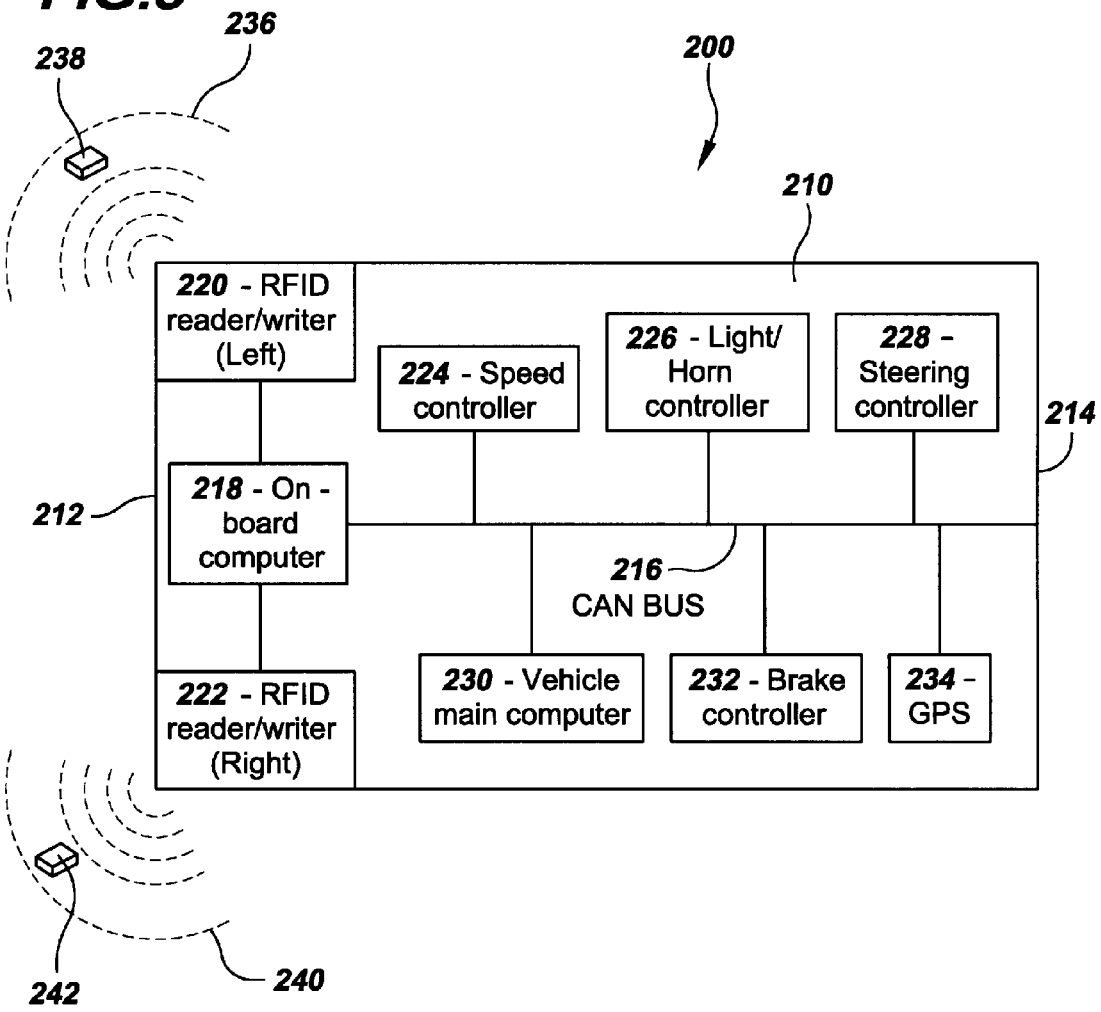
FIG. 3 shows a block diagram of an embodiment of a vehicle having multiple RFID transceivers connected to a vehicle control area network (CAN) bus.

FIG. 3 shows a block diagram 200 of an embodiment of a vehicle having multiple RFID transceivers connected to a vehicle control area network (CAN) bus. Vehicle 210, having a front end 212 and a rear end 214, may include a bus 216, such as a CAN bus. In other embodiments, other bus architectures may be used. Various vehicle control systems may be connected to bus 216, such as on-board computer 218, which may include a processor and memory components, speed controller 224, light/horn controller 226, steering controller 228, vehicle main computer 230, brake controller 232, and GPS controller 234.

A first RFID transceiver 220 may be connected to on-board computer 218 and may be located on one side of vehicle 210, while a second RFID transceiver 222 may be connected to on-board computer 218 and may be located on the other side of vehicle 210. Transceiver 220 may transmit a signal 236 that may be received by an RLM 238, while transceiver 222 may transmit a signal 240 that may be received by an RLM 242. In embodiments where the RLMs are located along the centerline of a two-lane road, RLMs 238 and 242 may be the same RLM. In such embodiments, when vehicle 210 is traveling on the left side of the road relative to the direction of travel, transceiver 220 communicates with the RLMs, and when vehicle 210 is travelling on the right side of the road relative to the direction of travel, transceiver 222 communicates with the RLMs.

Transceivers 220 and 222 may send signals received from RLMs to on-board computer 218, which may perform collision avoidance calculations. The outcome of the collision avoidance calculations may be sent to vehicle main computer 230. On-board computer 218 may also receive vehicle speed information and generate VIN for downloading into RLMs. The traffic location information from the RLMs and GPS information from GPS unit 234 may be justified with a map data base for providing accurate and reliable navigation and immediate traffic condition information. In an autonomous vehicle application, this navigation information may be combined with other information off bus 216, such as from speed controller 224, lights/horn controller 226, steering controller 228, and brake controller 232.

Figure 4A:
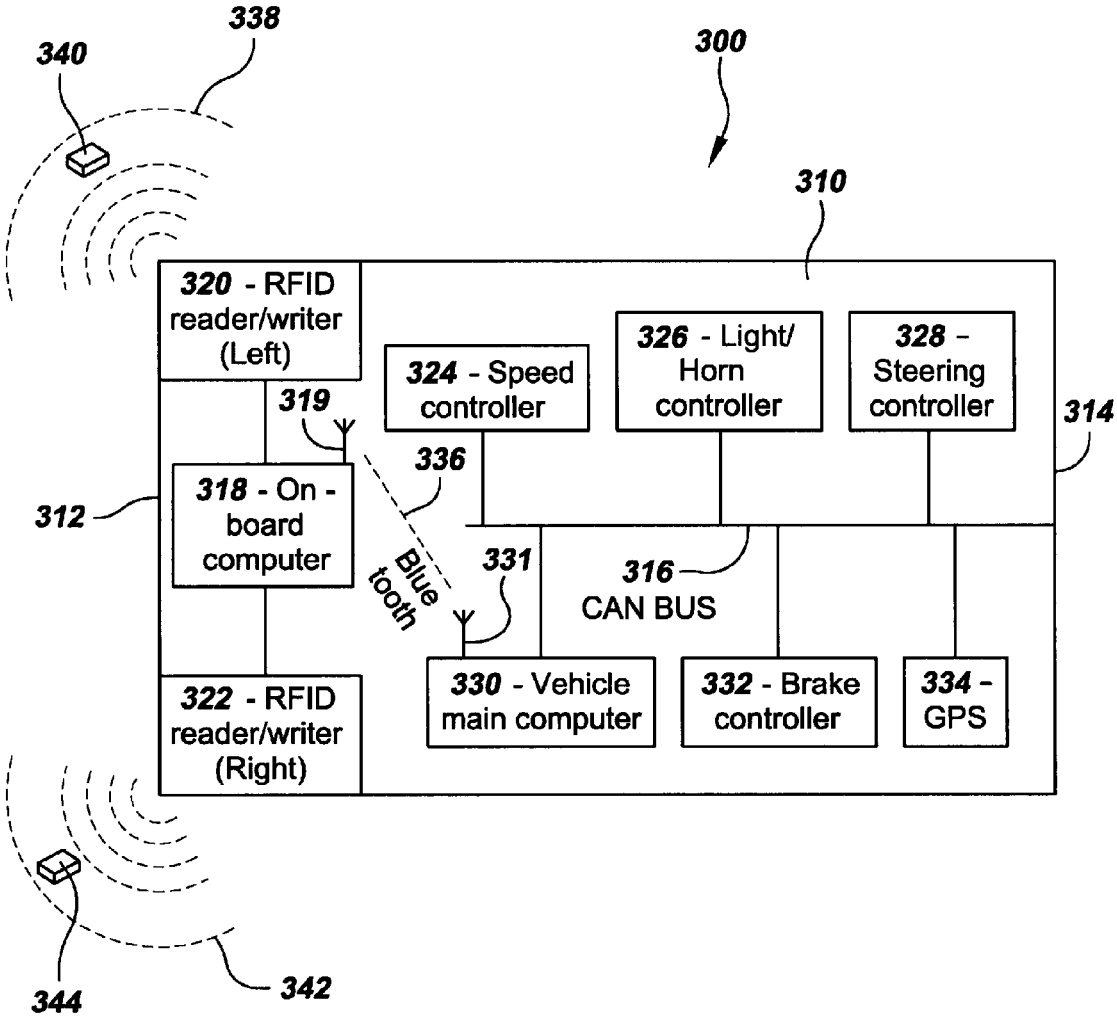
FIG. 4A shows a block diagram of an embodiment of a vehicle having multiple RFID transceivers wirelessly connected to a vehicle bus.

FIG. 4A shows a block diagram 300 of an embodiment of a vehicle having multiple RFID transceivers wirelessly connected to a vehicle bus. Vehicle 310, having a front end 312 and a rear end 314, may include a bus 316, such as a CAN bus. In other embodiments, other bus architectures may be used. Various vehicle control systems may be connected to bus 316, such as speed controller 324, light/horn controller 326, steering controller 328, vehicle main computer 330, brake controller 332, and GPS controller 334. Vehicle main computer 330, via antenna 319, may wirelessly communicate over link 336 with an on-board computer 318, via antenna 331. As an example, link 336 may be a Bluetooth connection. Vehicle 310 also includes transceivers 320 and 322, which may communicate with RLMs 340 and 344 via signals 338 and 342, respectively. Transceivers 320 and 322 may be configured similarly to transceivers 220 and 222 of FIG. 3.

Figure 4B:
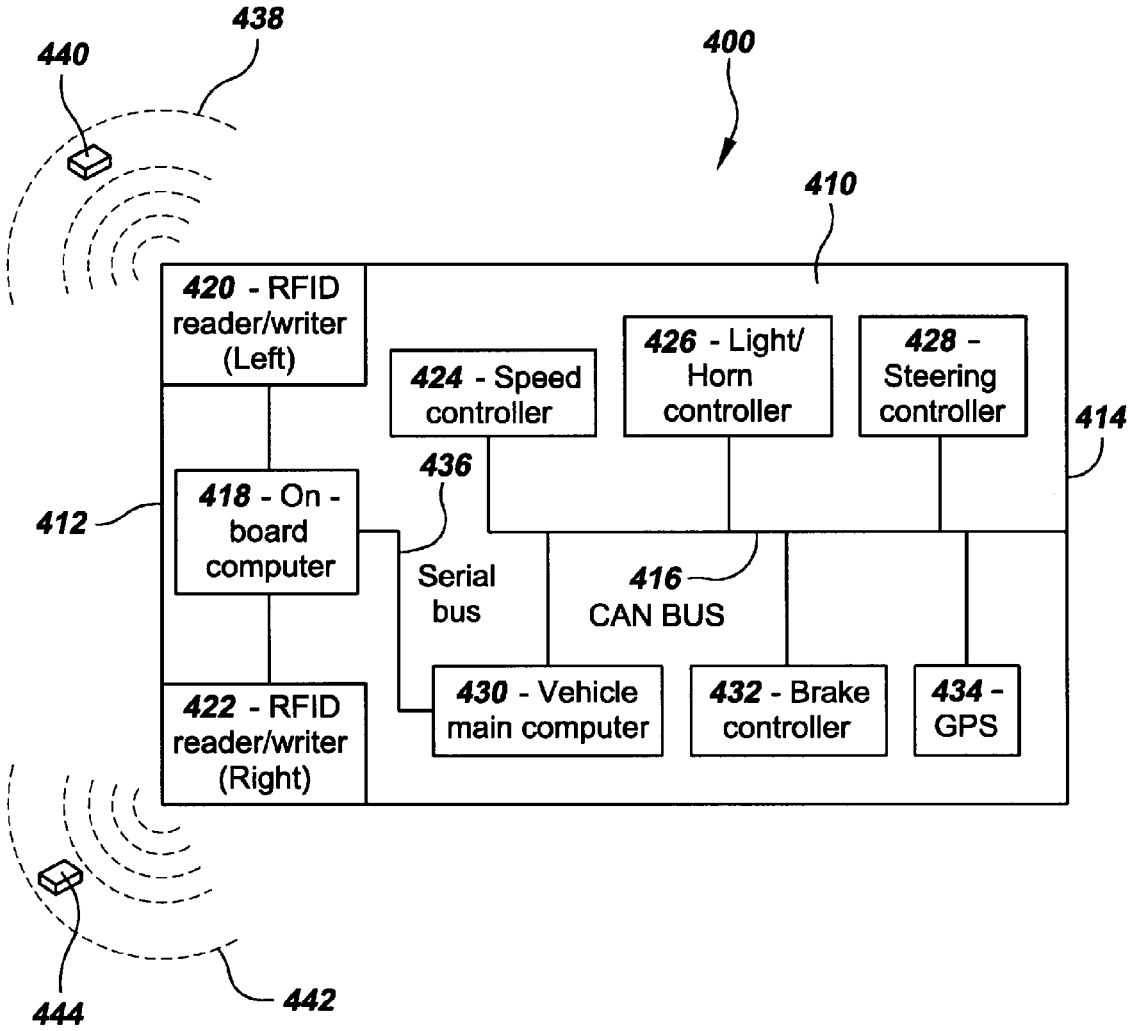
FIG. 4B shows a block diagram of an embodiment of a vehicle having multiple RFID transceivers serially connected to a vehicle computer.

FIG. 4B shows a block diagram 400 of an embodiment of a vehicle having multiple RFID transceivers serially connected to a vehicle computer. Vehicle 410, having a front end 412 and a rear end 414, may include a bus 416, such as a CAN bus. In other embodiments, other bus architectures may be used. Various vehicle control systems may be connected to bus 416, such as speed controller 424, light/horn controller 426, steering controller 428, vehicle main computer 430, brake controller 432, and GPS controller 434. Vehicle main computer 430 may be serially connected via connection 436 with on-board computer 318. As an example, link 436 may be a serial bus such as I2C, SPI, or UART. Vehicle 410 also includes transceivers 420 and 422, which may communicate with RLMs 440 and 444 via signals 438 and 442, respectively. Transceivers 420 and 422 may be configured similarly to transceivers 320 and 322 of FIG. 3.

Figure 5:
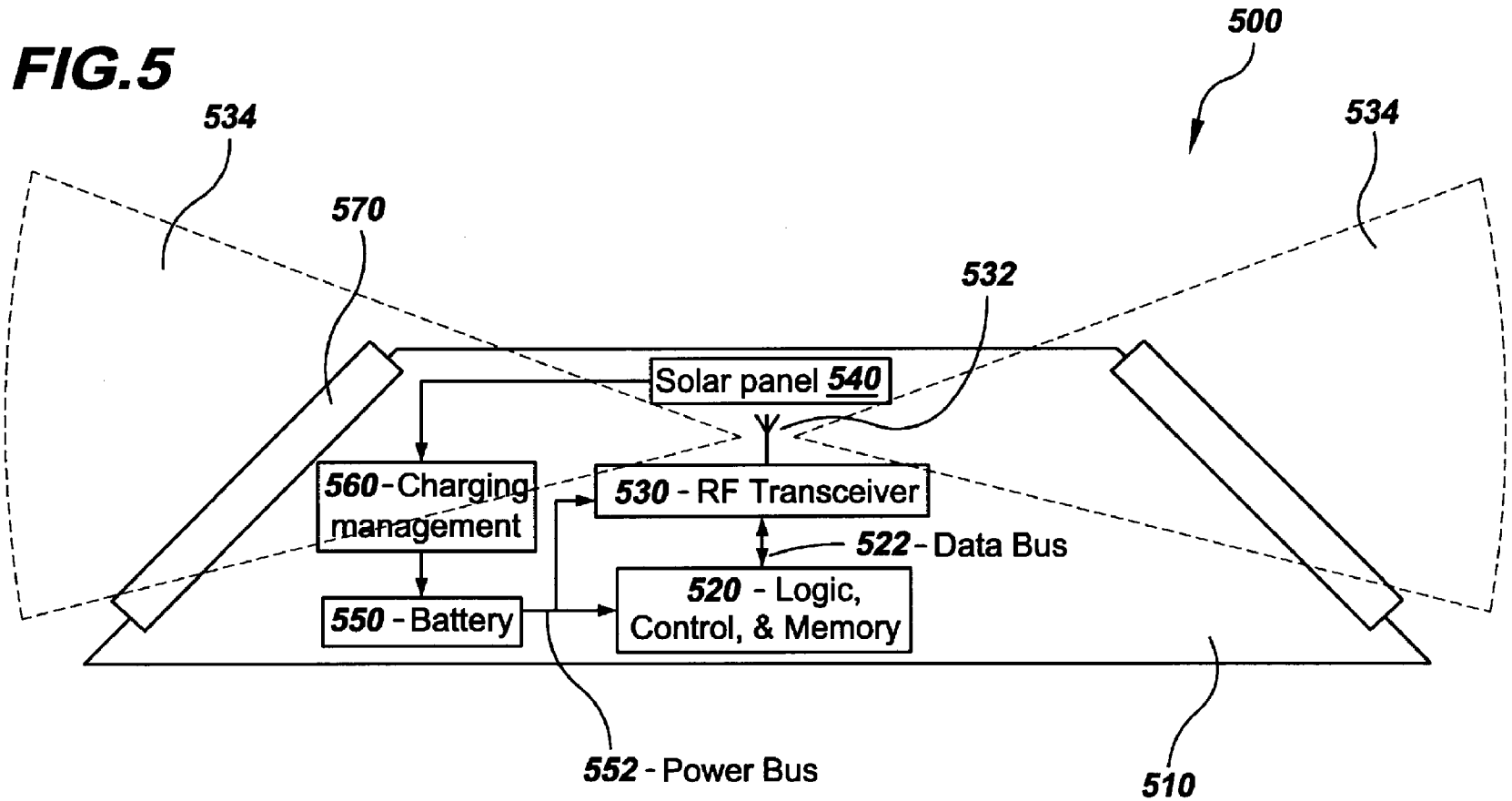
FIG. 5 shows a diagram of the internal architecture of an embodiment of a solar-powered RLM.

FIG. 5 shows a diagram of the internal architecture of an embodiment of an RLM 500. RLM 500 includes a base 510, a logic/control/memory component 520, an RF transceiver 530 with an antenna 532, a solar panel 540, a battery 550, a charging management component 560, and reflectors 570. Logic/control/memory component 520 may include a processor and memory having program instructions stored therein, and may be connected, via wire or wirelessly, to transceiver 530 via a data bus 522. Solar panel 540 may provide power to charging management component 560, which may charge battery 550 during daylight. During nighttime, light from the headlights of passing vehicles may shine on solar panel 540 and provide energy for use to power battery 550. Battery 550 may provide power to component 520 and transceiver 530 via a power bus 552. Antenna 532 may transmit a signal 534 to a vehicle or another RLM in a network of a plurality of connected RLMs.

In some embodiments, transceiver 530 contains more than one antenna and more than one transceiver 530. In such embodiments, the antennas are frequency selective. In other embodiments, one antenna 532 and transceiver 530 may serve all communications between vehicles and RLMs. Alternatively, one antenna 532 and transceiver 530 may serve communication with passing vehicles, while another antenna and transceiver serves communication with the RLM network.

In some embodiments, the RLMs only expend energy during data propagation following encounters with passing vehicles. As an example, such data propagation may occur for approximately 2 ms, with 1 ms for each of the transmit and receive actions within the network of RLMs. Power management processes may permit the RLM to hibernate when no traffic exists in the range of the RLM. An RLM may include a sniffer circuit that is configured to awaken the RLM when a communication arrives from either a vehicle or another active RLM.

In some embodiments, magnetic sensors may be incorporated into the RLMs. The magnetic sensors would allow RLMs to detect the presence of non-cooperating vehicles—vehicles without transceivers capable of communicating with the RLMs. Also, in some embodiments, algorithms local to the RLMs could use a sequence of detections in a network to estimate the direction and speed of the non-cooperating vehicles. The VIN of the non-cooperating vehicle would be assigned randomly. This information could then be propagated by the RLMs through the network as is done with VIN lines from cooperating vehicles.

In some embodiments, multiple RLMs may be connected to form a network. Such connection may be wired or wireless. RLMs may provide relative road location, direction of travel, and speed information to all vehicles within the network having the ability to communicate with the RLMs, that are within in the proximity of the recipient vehicle. The RLM's communication capability does not depend on availability of GPS, other communication between vehicles, or communication between vehicles and fixed high-powered transponders along a road. In some embodiments, vehicle information may be preserved in the network of RLMs only as long as the vehicle is on the road. In some embodiments, subject vehicle information is propagated by RLMs along the road only as far as is required for use by other similar vehicle collision avoidance systems given the subject vehicle's speed.

Figure 6:
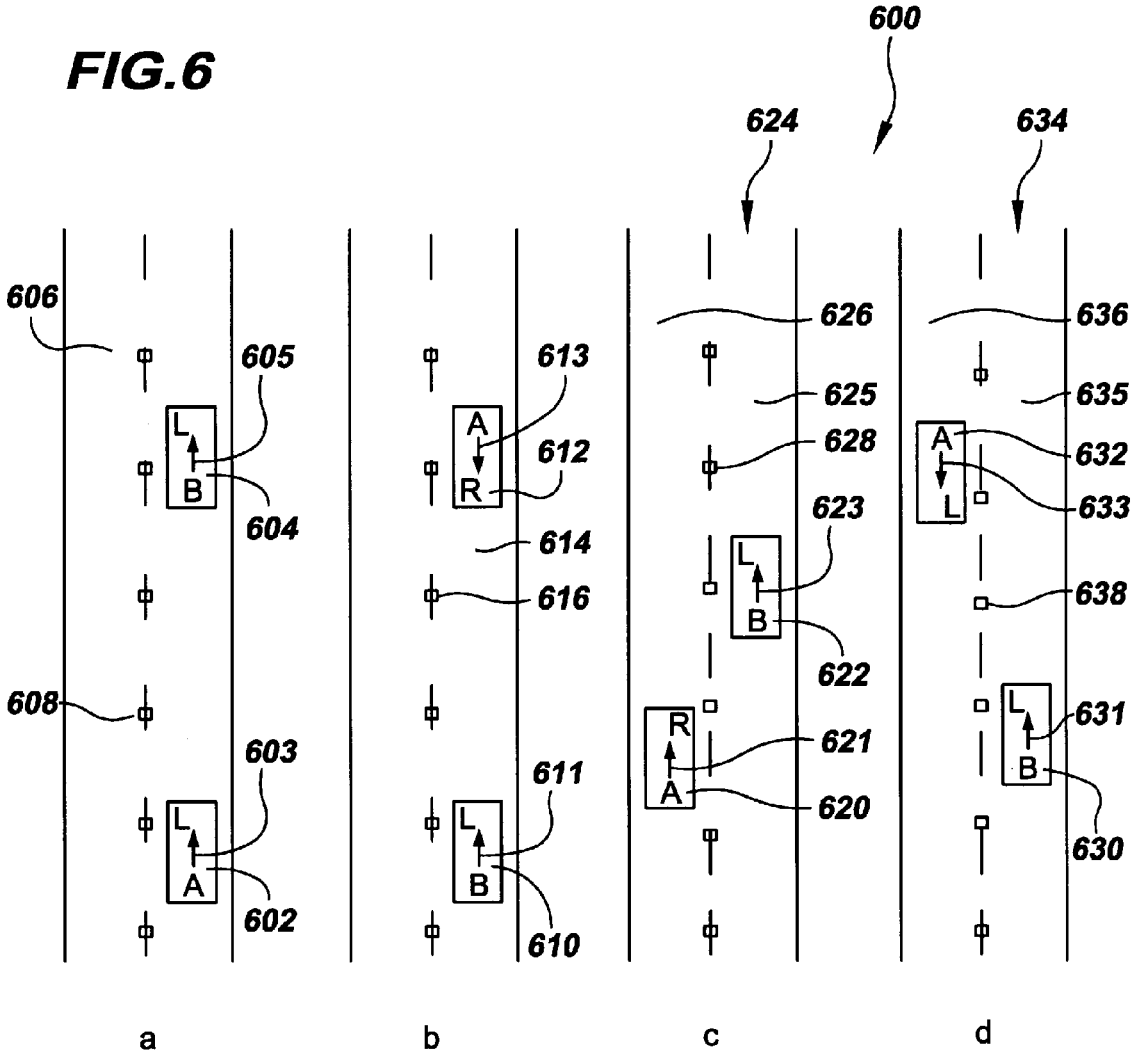
FIG. 6 shows a diagram of examples of combinations of approach of two vehicles on a two lane road.

FIG. 6 shows a diagram of examples of combinations of approach of two vehicles on a two lane road. As an example, FIG. 6 is discussed with reference to vehicles having more than one transceiver, with one located on each side of the vehicle. Each vehicle may have more or less transceivers, and in different configurations, without departing from the scope of the embodiments of the invention.

FIG. 6A shows a first vehicle 602 and a second vehicle 604 in the same lane of road 606. Vehicle 602 has a direction indicated by arrow 603, while vehicle 604 has a direction indicated by arrow 605. Arrows 604 and 605 indicate that vehicles 602 and 604 are headed in the same direction. Vehicles 602 and 604 are both communicating with RLMs 608 using transceivers located on the left side of the vehicle. Each vehicle communicates to the RLM network that they are traveling in the direction indicated in the same lane. A collision potential exists in this condition if vehicle 602 is travelling at a faster speed than vehicle 604.

FIG. 6B shows a first vehicle 610 and a second vehicle 612 in the same lane of road 614. Vehicle 610 has a direction indicated by arrow 611, while vehicle 612 has a direction indicated by arrow 613. Arrows 611 and 613 indicate that vehicles 610 and 612 are headed in the opposite direction. Vehicle 610 is communicating with RLMs 616 via the transceiver located on its left side, while vehicle 612 is communicating with RLMs 616 via the transceiver located on its right side. Each vehicle communicates to the RLM network that they are traveling in the direction indicated in the same lane. A collision potential exists in this condition regardless of the speed of either vehicle 610 or vehicle 612.

FIG. 6C shows a first vehicle 620 and a second vehicle 622 in different lanes of road 624. Vehicle 620 travels in lane 626 and has a direction indicated by arrow 621, while vehicle 622 travels in lane 625 and has a direction indicated by arrow 623. Arrows 621 and 623 indicate that vehicles 620 and 622 are headed in the same direction. Vehicle 620 is communicating with RLMs 628 via the transceiver located on its right side, while vehicle 622 is communicating with RLMs 628 via the transceiver located on its left side. Each vehicle communicates to the RLM network that they are traveling in the direction indicated in different lanes. There is no collision potential between vehicles 620 and 622 in this configuration.

FIG. 6D shows a first vehicle 630 and a second vehicle 632 in different lanes of road 634. Vehicle 630 travels in lane 635 and has a direction indicated by arrow 631, while vehicle 632 travels in lane 636 and has a direction indicated by arrow 633. Arrows 631 and 633 indicate that vehicles 630 and 632 are headed in opposite directions. Vehicle 630 is communicating with RLMs 638 via the transceiver located on its left side, while vehicle 632 is communicating with RLMs 638 via the transceiver located on its left side. Each vehicle communicates to the RLM network that they are traveling in the direction indicated in different lanes. There is no collision potential between vehicles 630 and 632 in this configuration.

FIG. 7 shows a diagram 700 of an example of the propagation of a vehicle identification range by multiple RLMs near an intersection. Diagram 700 includes roads 710 and 720, which intersect at intersection 760. A vehicle 730 is travelling along road 710. Vehicle 710 communicates with RLMs 712 coupled to road 710. RLMs 712 communicate with each other, as well as RLMs 722 coupled to road 720.

Vehicle 730 may communicate a hop number to the its nearest RLM 712. The hop number is the number of RLMs to which information about vehicle 730 is transmitted along the network of RLMs. If the number of RLMs along road 710 to which the information about vehicle 730 is transmitted includes an RLM at an intersection, such as RLM 714, the information about vehicle 730 may be transmitted from to RLMs 712 on road 710 and, via RLM 714, to RLMs 722 on road 720.

The number of RLMs along road 710 to which information about vehicle 730 is transmitted defines a vehicle information range 740, while the number of RLMs along road 720 to which information about vehicle 730 is transmitted defines a vehicle information range 750. The size of vehicle information ranges 740 and 750 may vary depending upon several factors. As an example, the size of vehicle information ranges may vary based upon vehicle information ranges of other vehicles within the network of RLMs, weather conditions, and/or traffic conditions within the network of RLMs.

FIG. 8 shows a diagram 800 of multiple vehicles within a vehicle identification range of a particular vehicle approaching an intersection. Diagram 800 includes roads 810 and 820, which intersect at intersection 870. Vehicles 830, 832, 834, and 836 are travelling along road 810, while vehicles 840 and 842 are travelling along road 820. Vehicles 830, 832, 834, and 836 each communicate with RLMs 812 coupled to road 810, while vehicles 840 and 842 each communicate with RLMs 822 coupled to road 820. RLMs 812 communicate with each other, as well as, via RLM 872, RLMs 822 coupled to road 820.

Vehicle 830 has a vehicle information range 850 along road 810 and a vehicle information range 860 along road 820. Vehicles 832 and 834 are within vehicle information range 850. Vehicle 840 is within vehicle information range 860. As a result, vehicles 832 and 834 are able to gain information about vehicle 830 via communication with RLMs 812, while vehicle 840 is able to gain information about vehicle 830 via communication with RLMs 822. Because vehicle 836 is outside of vehicle information range 850, and vehicle 842 is outside of vehicle information range 860, vehicles 836 and 842 cannot gain information about vehicle 830.

FIG. 9 shows a diagram 900 of the intersection of vehicle identification ranges for multiple vehicles. Diagram 900 includes vehicles 920, 930, and 940 travelling on road 910, which contains multiple RLMs 912. Vehicle 920 has a vehicle information range 922, vehicle 930 has a vehicle information range 932, and vehicle 940 has a vehicle information range 942. Vehicle information ranges 922 and 932 intersect at area 950, while vehicle information ranges 932 and 942 intersection at area 960.

Vehicle 920 is able to gain information about vehicle 930 because vehicle 920 has entered vehicle information range 932. However, vehicle 930 is not able to gain information about vehicle 920 because vehicle 930 is not covered by vehicle information range 920. Vehicles 920 and 930 are not able to gain information about vehicle 940. Similarly, vehicle 940 is not able to gain information about vehicles 920 and 930.

Figure 10:
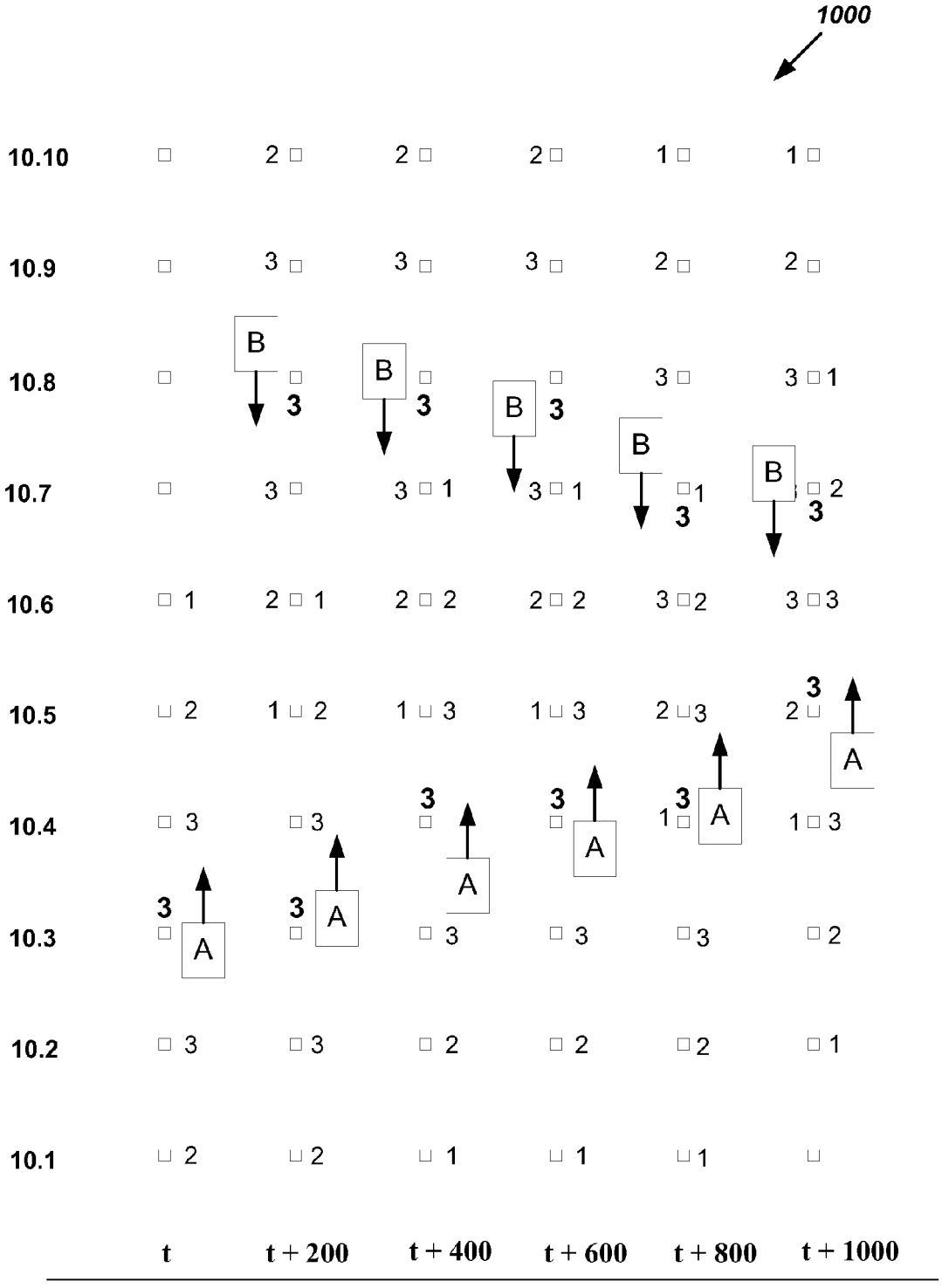
FIG. 10 shows an example of network state information on hop counts.

FIG. 10 shows a graphical depiction 1000 of an example of network state information on hop counts, using an example of two vehicles entering and traversing a two-lane road from opposite directions at speeds of ten miles-per-hour each. Time is represented across the horizontal axis, while distance is represented on the vertical axis. The time intervals over which network data is sampled are arbitrarily shortened to 200 msec to show the dynamics of the VIN ranges with vehicle progress down the road. Vehicle A enters the road and is first detected by RLM 10.3 a time t. The hop counts in the vehicle A VIN line for subsequent RLMs in the vicinity of vehicle A are shown to the right of RLMs 10.1-10.6. Vehicle B enters the road at t+200 msec and is first detected by RLM 10.8. The hop counts in the vehicle B VIN line for subsequent RLMs in the vicinity of vehicle B are shown to the left of RLMs 10.5-10.10. At t+400 msec, it is evident that vehicle A encountered RLM 9.4 sometime in the previous 200 msec.

The vehicle A VIN line in the data matrix at RLMs 10.5-10.7 is changed again with updated information for vehicle A. At t+600 msec, no changes in the network of RLMs occur as neither vehicle A nor B has encountered a new RLM, nor has either vehicle detected through the RLM network the presence of the other vehicle. The next update occurs before t+800 msec, when vehicle B communicates with RLM 10.7 and exchanges information. Vehicle B reads the data matrix contained in RLM 10.7 and learns of the presence of vehicle A traveling north at 10 mph thirty feet away in the opposite lane. Between t+800 msec and t+1000 msec, vehicle A encounters RLM 10.5 and learns that vehicle B is traveling south at a distance of twenty feet in the opposite lane at 10 mph.

Figure 11:
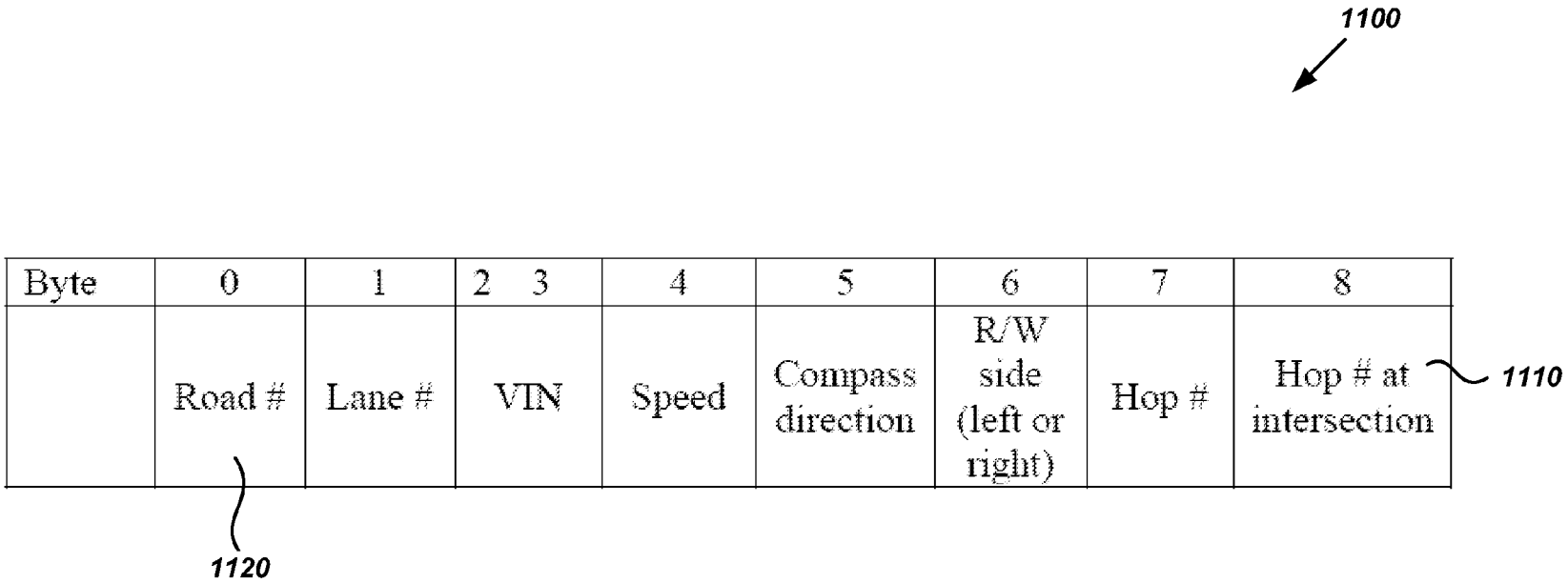
FIG. 11 shows a diagram illustrating an example of the contents of a vehicle information vector.

FIG. 11 shows a diagram 1100 illustrating an example of the contents of a vehicle information vector. A vehicle information vector 1110 may contain several fields 1120, each represented by bytes of data. As an example, vector 1110 may contain fields 1120 including road number, lane number, VIN, speed, compass direction, transceiver location, hop number, and hop number at intersection. Vehicle information vectors 1110 from multiple vehicles may be combined into a vehicle data matrix. The vehicle data matrix may be stored within the memory of an RLM and may be updated each time the RLM receives data regarding a vehicle.

Figure 12:
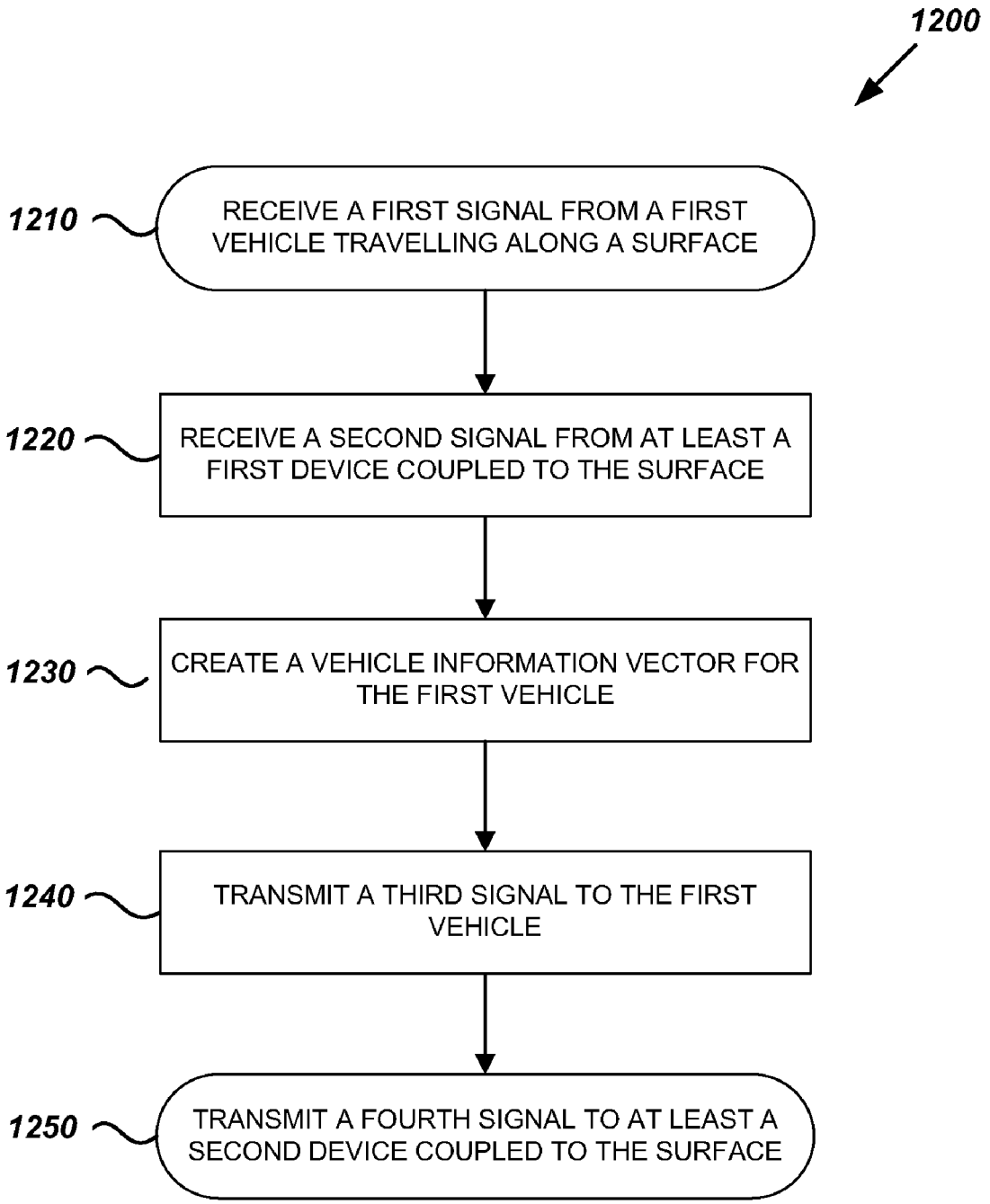
FIG. 12 shows a flowchart of a method in accordance with one embodiment of the Method for Vehicle Collision Avoidance.

FIG. 12 shows a flowchart of a method 1200 in accordance with one embodiment of the Method for Vehicle Collision Avoidance. Method 1200 may begin at step 1210, which involves receiving a first signal from a first vehicle travelling along a surface. In some embodiments, the device may be coupled to the surface. In other embodiments, the device may be located proximate to the surface, such as adjacent to the surface, above the surface, or attached to a support in proximity to the surface. In some embodiments, the surface may comprise a road. The first signal may include operational data of the first vehicle. Operational data may include vehicle speed, direction of travel, transceiver location with respect to the first vehicle, and hop number.

In some embodiments, the first signal may be received by a device such as an RLM. For illustration purposes, method 1200 will be discussed with reference to RLM 500 described herein. However, the performance of method 1200 is not limited to RLMs, as method 1200 may be performed by other devices having the capability to perform the steps of method 1200. Referring to RLM 500, the first signal received in step 1210 may be received by antenna 532 and transmitted along data bus 522 to logic/control/memory component 520 for processing.

Method 1200 may then proceed to step 1220, which involves receiving a second signal from at least a first device coupled to the surface. The second signal may include operational data of at least a second vehicle. Similar to the receipt of the first signal, RLM 500 may receive the second signal at antenna 532 and may transmit the second signal along data bus 522 to logic/control/memory component 520 for processing. In some embodiments, the first device may be a different RLM from the RLM receiving the first signal. For example, the RLM transmitting the second signal may be located proximate to the RLM receiving the second signal. In some embodiments wherein the RLMs are coupled to a surface, such as a road, the RLM transmitting the second signal may be located at a distance along the road from the RLM receiving the second signal, as shown in FIGS. 2 and 7-9.

In some embodiments, the first device and second device are included within a network comprising a plurality of connected devices, as shown in FIGS. 2 and 7-9. The network may include vehicle operational data of a plurality of vehicles. Such vehicle operational data may be stored in logic/control/memory component 520. In such embodiments, the plurality of connected devices may be uniformly distributed along the road. In some embodiments, the plurality of connected devices are RLMs, such as RLMs 10 and 500.

Method 1200 may then proceed to step 1230, which involves creating a vehicle information vector for the first vehicle. The creation of the vehicle information vector by RLM 500 may be performed by logic/control/memory component 520. In some embodiments, the vehicle information vector comprises roadway identification, travel lane identification, vehicle identification data, and/or vehicle operational data. In some embodiments, the vehicle information vector comprises other vehicle information. Vehicle operational data may include vehicle speed, direction of travel, transceiver location on the vehicle, and hop number. In some embodiments, the hop number determines a vehicle information range for the first vehicle. The size of the vehicle information range may be dependent upon the speed and momentum of the first vehicle. The location of the center of the vehicle information range may be dependent upon the location of the first vehicle within the network of RLMs Step 1240 of method 1200 may involve transmitting a third signal to the first vehicle. Step 1240 may be performed by logic/control/memory component 520 transmitting a signal to transceiver 530 along data bus 522, which is then transmitted to the first vehicle via antenna 532. The third signal may include at least some of the operational data of at least the second vehicle. In some embodiments, the third signal comprises all of the received operational data of at least the second vehicle. In some embodiments, the third signal includes other information, such as GPS coordinates of the device transmitting the third signal, traffic signal status and/or toll booth status of a traffic signal and/or toll booth located in the vehicle's upcoming path, and lane availability status.

Step 1250 involves transmitting a fourth signal to at least a second device coupled to the surface. Step 1250 may be performed by logic/control/memory component 520 transmitting a signal to transceiver 530 along data bus 522, which is then transmitted to the second device via antenna 532. The second device may be an RLM different from the RLM transmitting the second signal. The fourth signal may include at least some of the operational data of the first vehicle and at least some of the operational data of the second vehicle. The fourth signal may include vehicle information vectors for all other vehicles within the network within range of a particular device within the network to which the first vehicle is in communication. As an example, if an RLM in communication with a first vehicle is also in the VIN ranges of four other vehicles, the fourth signal may include vehicle information vectors for all five of the vehicles in communication with the RLM. The vehicle information vectors of the fourth signal may each contain specific vehicle identification, speed, heading, decremented hop count, roadway of transit identification, location with respect to the roadway, and hop count at any intersection within range.

Figure 13:
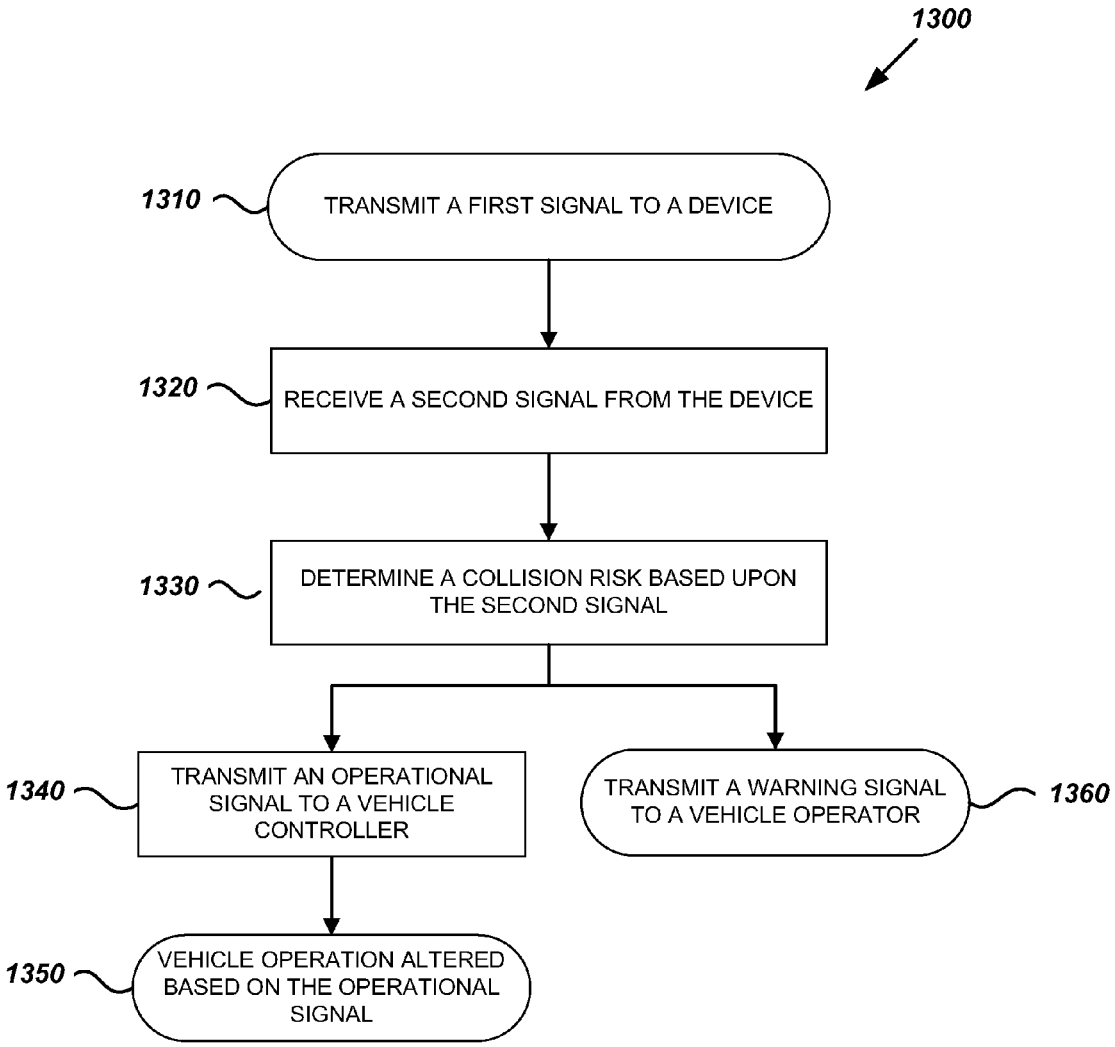
FIG. 13 shows a flowchart of a method in accordance with one embodiment of the Method for Vehicle Collision Avoidance.

FIG. 13 shows a flowchart of a method 1300 in accordance with one embodiment of the Method for Vehicle Collision Avoidance. Method 1300 may begin at step 1310, which involves transmitting a first signal to a device. In some embodiments, the first signal may comprise vehicle identification data and vehicle operational data. The device may be, for example, an RLM such as RLM 10 or 500 as described herein. The device may be located within a network having a plurality of connected devices. The network may include vehicle identification data and vehicle operational data of a plurality of vehicles that are within the network. In some embodiments, the first signal may be transmitted by a vehicle, such as, for example, vehicles 210, 310, or 410 as described herein. For illustration purposes, method 1300 will be discussed with reference to vehicle 210. Step 1310 may be performed by on-board computer 218 sending a signal to either transceiver 220 or 222, depending on which transceiver is nearest to the RLM, to cause the transceiver to transmit the first signal to the RLM. In some embodiments, the first signal may be generated by on-board computer 218.

Method 1300 may then proceed to step 1320, which involves receiving a second signal from the device. The second signal may be received by antennas on or within either transceiver 220 or transceiver 222, depending on which is nearest to the device. In some embodiments, the second signal may comprise road and lane information and vehicle information vectors of other vehicles transiting the road when their VIN ranges encompass the device. In some embodiments, the second signal may comprise similar information as the third signal transmitted in step 1240 of method 1200. Step 1330 may then involve determining a collision risk based upon the received second signal. The determination of the collision risk may be performed by on-board computer 218. In some embodiments, the collision risk includes risks of collisions with one or more of the plurality of vehicles within the network. In some embodiments, the collision risk is determined by comparing vehicle data with location data and vehicle operational data of one or more other vehicles of the plurality of vehicles within the network.

In some embodiments of step 1330, collision risk may be determined by a set of rules, such as the following set of rules:

1. If the hop count associated with a unique VIN is increasing, then the vehicle associated with the VIN is approaching and its relative distance is decreasing;
2. If the hop count associated with a unique VIN is decreasing then the vehicle associated with the VIN is receding and its relative distance is increasing;
3. If the hop count associated with a unique VIN is constant, then the relative speed between the host vehicle and the foreign vehicle is constant;
4. If rule #1 is true and if that VIN is associated with the same road ID (including lane of travel) as the host vehicle, then a collision is possible;
5. If rule #4 is true and if the travel direction codes are the same while the sensor codes are the same, the collision risk is increased;
6. If rule #4 is true and if the travel direction codes are different while the sensor codes are different then the collision risk is increased;
7. If either rule #5 or rule #6 is true and if the closing speed of the two vehicles exceeds a hop-count dependent threshold then a collision is imminent and a collision warning is produced or collision avoidance maneuvers, such as braking, are initiated;
8. If rule #1 is true and the road ID is different, then an intersection collision risk is possible;
9. If rule #8 is true and if the calculated time of arrival at the intersection of both vehicles is the same given the current speeds and distances, collision risk is increased;

Time of arrival may be determined for the object vehicle by multiplying the intersection posted hop count by the nominal inter-RLM distance, and dividing by the object vehicle speed; and for the host vehicle by multiplying the difference of the hop count for the object vehicle and the intersection posted hop count by the nominal inter-RLM distance, and dividing by host vehicle speed;

10. If rule #9 is true and if the closing speed of the two vehicles exceeds a hop-count dependent threshold then a collision is imminent and a collision warning is produced or collision avoidance maneuvers, such as braking, are initiated;

11. In all other cases the collision risk is low.

Method 1300 may then proceed to step 1340, which involves transmitting an operational signal to a vehicle controller. Step 1340 may be performed by on-board computer 218 transmitting a signal along bus 216 to one or more controllers, such as speed controller 224, steering controller 228, brake controller 232, or GPS component 234. In some embodiments, transmission of the operational signal may occur if the determined collision risk exceeds a predetermined threshold.

Following step 1340, method 1300 may proceed to step 1350, wherein the operation of the vehicle is altered by the particular vehicle controller based upon the received operational signal. In some embodiments, the operation of the vehicle may be altered to minimize the determined collision risk. In such embodiments, the operational signal may alter at least one vehicle operation, such as acceleration, deceleration, and steering. In some embodiments, the determined collision risk includes risks of collision with more than one vehicle. Such risks of collision with more than one vehicle may include a highest probable risk of collision. In such embodiments, the operational signal may alter at least one vehicle operation to minimize the highest probable risk of collision. As an example, if the operational signal causes a first vehicle to brake to prevent the first vehicle from colliding with a slow-moving second vehicle in front of the first vehicle, thus removing the highest probable risk of collision, a lower risk of collision may still exist with a third vehicle travelling behind the first vehicle. In other embodiments having risks of collision with more than one vehicle, the operational signal may cause the first vehicle to change lanes to avoid risks of collisions with a second vehicle and a third vehicle, thus minimizing the total risk of collision.

In other embodiments of method 1300, rather than proceeding to step 1340 after step 1330, method 1300 may proceed to step 1360. Step 1360 may involve, if the determined collision risk exceeds a predetermined threshold, a vehicle computer, such as on-board computer 218, causes a warning signal to be transmitted to a vehicle operator. The predetermined threshold may be any indicator, such as a number, and may be stored in non-volatile memory within the vehicle computer. In some embodiments, the warning signal may be transmitted to a vehicle controller, such as light/horn controller 226. The warning signal may cause the triggering of a vehicle operator warning device, such as a vehicle horn, light, or siren. The triggered vehicle operator warning device may cause the vehicle operator to alter the operation of the vehicle to avoid a collision with another vehicle.

Methods 1200 and 1300 may be represented by computer readable programming code and stored on a computer readable storage medium. Methods 1200 and 1300 may be implemented using a programmable device, such as a computer-based system. Methods 1200 and 1300 may be implemented using various programming languages, such as "C" or "C++".

Various computer-readable storage mediums, such as magnetic computer disks, optical computer disks, electronic memories and the like, may be prepared that may contain program instructions that direct a device, such as a computer-based system, to implement the steps of methods 1200 and 1300. Once an appropriate device has access to the program instructions contained on the computer-readable storage medium, the storage medium may provide the information and programs to the device, enabling the device to perform methods 1200 and 1300.

For example, if a computer disk containing appropriate materials, such as a source, object, or executable file is provided to a computer, the computer may receive the information, configure itself, and perform the steps of methods 1200 and 1300. The computer would receive various portions of information from the disk relating to different steps of methods 1200 and 1300, implement the individual steps, and coordinate the functions of the individual steps.

Many modifications and variations of the Method for Vehicle Collision Avoidance are possible in light of the above description. Within the scope of the appended claims, the Method for Vehicle Collision Avoidance may be practiced otherwise than as specifically described. Further, the scope of the claims is not limited to the implementations and embodiments disclosed herein, but extends to other implementations and embodiments as may be contemplated by those having ordinary skill in the art.

We claim:

1. A non-transitory computer readable storage medium having instructions encoded thereon comprising:

transmitting vehicle information from a first vehicle to a first device coupled to a road, the first device included within a network of operatively connected devices distributed along the road, the first device located outside of a road intersection, the vehicle information comprising at least a vehicle speed, a vehicle direction, and a vehicle information number (V1N);

determining a vehicle information range (VIR) for the first vehicle based upon a hop number of the first vehicle, wherein the size of the VIR is dependent upon the vehicle speed;

creating a vehicle information vector (VIV) from the vehicle information, the VIV comprising a road number of the first vehicle, a lane number of the first vehicle, the vehicle speed, the vehicle direction, and the V1N;

transmitting the VIV from the first device, via other devices within the network of operatively connected devices located within the VIR of the first vehicle, to a second vehicle located within the VIR of the first vehicle; and determining a collision risk for the second vehicle based upon the road number of the first vehicle, the lane number of the first vehicle, the VIN, and the hop number associated with the first vehicle.

2. The non-transitory computer readable storage medium of claim 1, wherein the step of determining a collision risk for the second vehicle comprises the steps of:

determining that the hop number associated with the VIN of the first vehicle is increasing; and determining that a collision risk on the same road is possible if the road number of the first vehicle is the same as a road number of the second vehicle.

3. The non-transitory computer readable storage medium of claim 1, wherein the step of determining a collision risk for the second vehicle comprises the steps of:

determining that the hop number associated with the VIN of the first vehicle is increasing; and determining that a collision risk at the road intersection is possible if the road number associated with the VIN of the first vehicle is not the same as a road number associated with the VIN of the second vehicle.

4. The non-transitory computer readable storage medium of claim 3, wherein the step of determining a collision risk for the second vehicle further includes the steps of:

calculating a time of arrival at the road intersection for both the first vehicle and the second vehicle; and determining that the collision risk at the road intersection is increased if the calculated time of arrival for the first vehicle is the same as the calculated time of arrival for the second vehicle given current speeds and distances of the first vehicle and the second vehicle.

5. The non-transitory computer readable storage medium of claim 4, wherein the step of determining a collision risk for the second vehicle further includes the step of determining that a collision is imminent if a closing speed of the first vehicle and the second vehicle exceeds a hop-count dependent threshold.

* * * * *